United States Patent [19]

Brunner

[11] Patent Number: 4,846,002

[45] Date of Patent: Jul. 11, 1989

[54] RACKET-STRINGING TESTER

[76] Inventor: Adolf Brunner, Baslerstrasse 37/1, D-7880 Bad Säckingen, Fed. Rep. of Germany

[21] Appl. No.: 89,706

[22] Filed: Aug. 26, 1987

[30] Foreign Application Priority Data

Aug. 29, 1986 [DE] Fed. Rep. of Germany ..... 3629529

[51] Int. Cl.[4] ..... G01L 5/04

[52] U.S. Cl. ..... 73/862.47; 273/73 B

[58] Field of Search ..... 273/73 R, 73 A, 73 B, 273/73 D, 73 E; 73/781, 862.39, 862.42, 862.43, 862.47, 862.48

[56] References Cited

U.S. PATENT DOCUMENTS

| | | | |
|---|---|---|---|
| 1,322,123 | 11/1919 | Larson | 73/862.47 |
| 1,833,195 | 11/1931 | Albright Jr. | 73/862.47 |
| 4,055,999 | 11/1977 | Cope | 73/862.47 |
| 4,103,546 | 8/1978 | Hickey et al. | 73/862.47 |
| 4,590,808 | 5/1986 | Lightfoot et al. | 73/862.48 |

FOREIGN PATENT DOCUMENTS

| | | | |
|---|---|---|---|
| 2506938 | 12/1982 | France | 273/73 E |
| 2509184 | 1/1983 | France | 273/73 R |

*Primary Examiner*—Richard C. Pinkham
*Assistant Examiner*—William E. Stoll
*Attorney, Agent, or Firm*—Gilbert L. Wells

[57] ABSTRACT

A device for testing the stringing tension of a racket is made up of two components. The first component has a racket support surface with a recess therein. The second component is a cylinder containing a spring in compression with a slot in the cylinder indicating the compression load on the spring. The components are connected together with a connecting bolt passing through the racket. A spindle mounted on the connecting bolt and the first component applies pressure between the two components, acts on the strings of the racket and indicates racket tension by the amount of compression applied to the spring of the second component. The connecting bolt can also be threaded and the second component cylinder can be threaded thereon to apply pressure between the components. Distance sensing electrical contacts in the recess of the first component indicate when the reading is to be made.

4 Claims, 1 Drawing Sheet

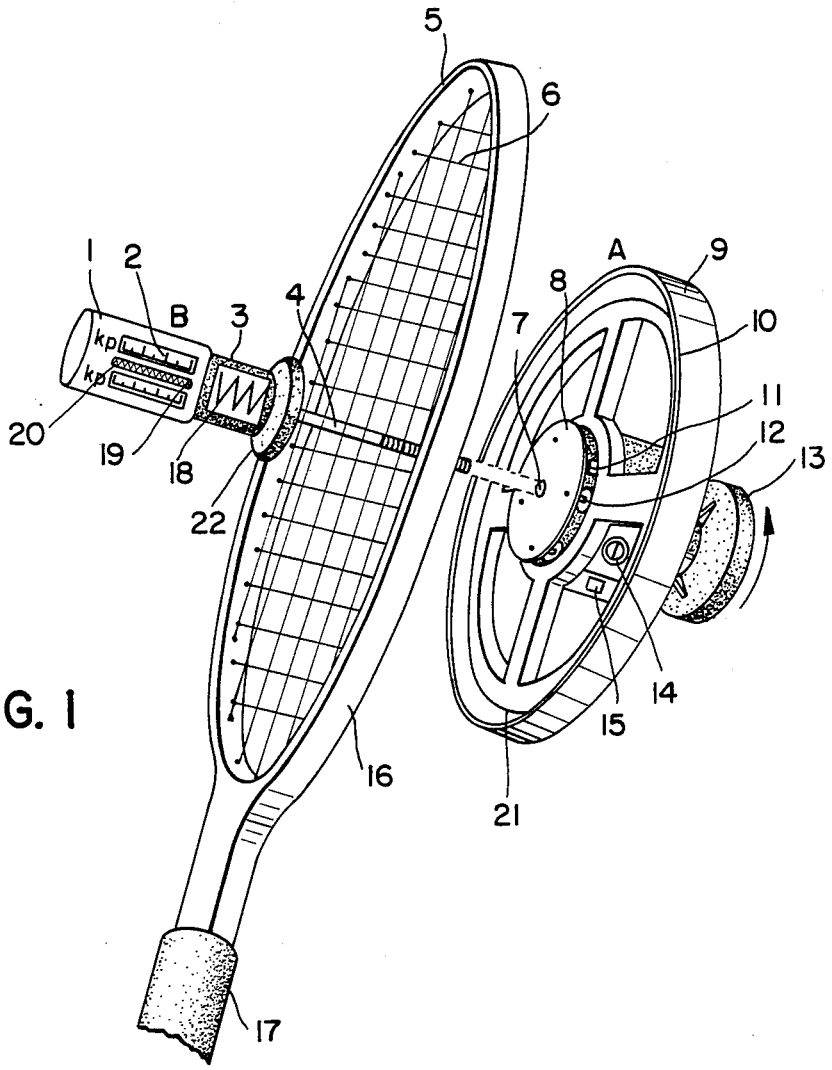
FIG. 1
FIG. 2
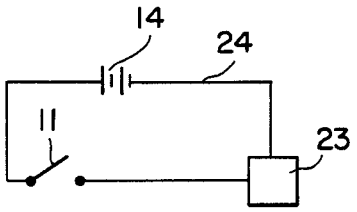

RACKET-STRINGING TESTER

CROSS-REFERENCE TO A RELATED APPLICATION

Applicant claims priority under 35 USC 119 for application No. P 36 29 529.7 filed Aug. 29, 1986 in West Germany.

BACKGROUND OF THE INVENTION

The invention concerns a device for rapidly testing the stringing of a racket, particularly rackets for ball games, without anything having to be built into the racket itself.

Customary devices for testing the stringing of a racket are big and complicated and therefore generally unsuitable for use by racket owners.

The frame of the racket is placed on supports and the tension of the stringing is measured with weights.

The designs are such that due to the size and weight of the individual components of the testing devices and of the devices themselves, it is difficult to test low stringing tensions, e.g., of badminton or squash rackets and high tensions, e.g., of tennis rackets with a single device, without resorting to very elaborate measures.

The handling, size and price of these devices make them unsuitable for the individual racket owner.

The stringing is one of the most important elements of a racket. The quality of the game, i.e., the continually steady game of a player depends to a great extent on the quality (e.g., tension) of the stringing.

The possibility to test the tension of the stringing or to establish a decisive change rapidly and dependably is every player's desire. A tension that is either too high or too low can, e.g., in the case of tennis, damage a player's health. Tennis-elbow, well-known and feared by all tennis players, or other muscular pains can be caused by changes to the stringing of a racket.

The manufacturers of tennis and of other rackets have established and defined the presumably correct stringing tension of each type of racket.

Beyond that there are players who need or want a degree of stringing tension suited to the level of their game. So in this case too, a variation negatively influences the quality of the game. Therefore it is of the utmost importance for every player to be able to test the stringing tension himself rapidly and immediately. A constant stringing tension is one of the elements of constant ball-sense and for a constant level of play.

Additionally, after a racket has been newly strung, variations appear within a matter of hours, which can reach up to 10% of the stringing tension applied. These variations differ depending on the materials, and to date could not be recognized by the players themselves.

SUMMARY OF THE INVENTION

The basis of this invention was the problem of providing a tester for strings suitable for all types of rackets, which—at the same time—should be of great use for every racket owner because of its size, handiness and cost-effectiveness. Changes to the stringing tension can be established at any time and place, so the stringing can always be subjected to testing.

The problem is solved by two separate components A and B which are connected (screwed together) during the testing procedure to form this inventive device.

BRIEF DESCRIPTION OF THE DRAWING

The invention is best described by reference to the appended drawings, wherein:

FIG. 1 is a perspective showing of tester components A and B mounted on a racket; and FIG. 2 is a detailed showing of the contact, circuit, signal and power supply.

DESCRIPTION OF THE PREFERRED EMBODIMENTS

The connecting bolt (4) of part B, itself to be considered as a complete measuring cylinder, is introduced into the hole (7) of part A through the middle of the stringing (6) and screwed or clamped into position with the spindle (13).

Part (3) of the measuring cylinder (b) introduced into part (1) is movable, resp. can slide and is locked by the locking screw (19) which itself moves in slot (20) and locks when fastened to part (3). The tension spring (compression spring 18) forces the movable parts (1) and (3) into their original position, so that the locking screw or bolt holds together parts (1) and (3) as a unit.

The connecting bolt (4) is joined to the movable part (1) which is over part (3) and comes out of the measuring cylinder through the center of the spring (18) and part 93). The connecting bolt (4) is centered as it comes out of part (3).

Depending on the tension of the spring (18), the applied force is read-off in Kp via the movable locking screw (19) when pressing parts (1) and (3) together. This compression is achieved by the pulling of the connecting bolt (in the direction of part A) by device (A) and the support of part (B) on the stringing of the racket. There is a read-off indicating arrow on the locking screw (19).

The measuring- and support-system (A) is placed on the opposite side of the stringing and measuring cylinder (B) with its support-surface (10) and inserted into the hole (7) with the connecting bolt (4) and screwed in with the spindle (13).

On part (A) there is a recess (21). In it the measuring plate (8) is movably fastened with bolts and the reset-spring (12) to the support rim (9).

The connecting bolts which are movable in part (A) and firmly fixed to the measuring plate (8) lock the measuring plate in the direction of the measuring cylinder (B) and allow it free movement in the opposite direction.

At the end of the predetermined movement of the measuring plate (8) in the direction of the support rim (9) there is an electrical contact (11) which gives an acoustic signal (23) through an electronic circuit (24) when the measuring plate is pressed-on. The acoustic signal's power supply is a button cell (14).

By tightening the measuring cylinder (B) with bolt (4) and spindle (13) the support-surface (22) is pulled to the stringing.

The measurement of the stringing tension is effected between the support rim (9) and the support-surface (22) by the force generated by the spring (18) as a result of the distance that bolt (4) has to be screwed into the spindle (13).

The diameter of the surface (22) is 7 to 30 mm, of the surface (10) 100 to 200 mm, but is not restricted to these dimensions.

By the pressure build-up of the support-surface (22) and the constant opposing pressure of the surface (10)

the stringing is pressed to the measuring plate (8) and moves it in the direction of the electric switch (11).

The spring (18) has been calibrated to the stringing tension determined as correct for the racket, so that via the predetermined movement of the measuring plate (8) until it reaches switch (11), and thus to the acoustic signal, a defined force and travel of the spring is necessary, which can be read-off on the scale (2). This reading indicates the actual stringing tension.

Because of the two separate interacting systems A and B the thickness of the strings does not have to be taken into account. The support-surface (10) and the movement of the stringing which acts on the measuring plate (8) are effected within the same device (B). This means that the support-surface (10) and the measuring plate (8) together always have the same starting point, irrespective of the thickness of the strings.

The invention put forward herewith therefore concerns a device to test the stringing tension of a racket, a device distinguished by two parts which consist on the one hand of a pressure measuring system (B) as described in part B, and on the other hand of a distance measuring system (A) as described for part A.

The device is further distinguished by the fact that the support-surfaces of the pressure measuring system B (22) and of the distance measuring system A (10) have different surface areas which enable measurement within the complete system via the recess (21) and the measuring plate (8), independent of the size of the racket and the tension of the stringing, and which announce the desired value through an acoustic signal, which value can be read-off on scale (12).

By changing the spring (18) or the complete measuring cylinder (B) it is possible to measure the stringing tension of different rackets for various kinds of games.

The measuring plate (8) is inside a recess of the support-surface (10). The device can be modified. By locking the spindle (13) in part A, or by leaving it out altogether, whereby the measuring cylinder B is used as a screwing unit which is drawn into part A by a fixed thread and so fulfills the function of the spindle (13), a different version is obtained.

The device can also use a mechanical clicking signal instead of the electro-acoustical one.

Instead of the spring (18) or in combination with it, a component can be used which allows electronic measurement of the stringing tension and which can transmit the measured values through appropriate electronic indicators.

Instead of the screw-connection to the spindle (13) a system of levers can be used which act on the tension bolt (4).

Instead of the screw-connection, a magnet can carry out the function of the screw-connection between A and B.

Another version of the device uses a variable electrical resistor in connection with the variable travel of the spring (18) which indicates the pressure and therefore the stringing tension through an electrical analogue or digital indicator.

The invention represents an exceptional technical advance since it now enables the stringing of a racket, particularly a tennis racket, to be measured simply and rapidly by any amateur or professional with a device which is both simple to use and cheap.

This means that anyone can change the racket or the stringing individually at the right time.

I claim:

1. An apparatus for testing the stringing tension of a racket having strings on a frame for use in ball games, comprising:

(A) a distance measuring component having a first support surface for a racket, a recess in said first support surface, a measuring plate biasly mounted in said recess to a first position away from said recess and a second compressed position within said recess, means for indicating said second position;

(B) a pressure measuring system having a second support surface smaller than said first support surface, a first cylinder connected to said second support surface, a second cylinder larger than said first cylinder and adapted to telescope onto said first cylinder, a longitudinal slot in said second cylinder, a spring within said second cylinder and compressed thereby, an indicator mounted on said spring extending into said slot holding said cylinders together and said spring under compression; and (C) a threaded bolt connecting components (A) and (B) for applying pressure to racket strings between said components (A) and (B).

2. The apparatus of claim 1, wherein said means for indicating said second position are an electrical contact adapted to contact said measuring plate in said second position, means for generating an acoustical signal, a power supply and an electronic circuit connecting said electrical contact, power supply and means for generating an acoustical signal.

3. The apparatus of claim 2, wherein said measuring plate is biasly mounted by bolts extending through said plate into said recess and springs mounted on said bolts between said plate and said recess.

4. The apparatus of claim 3 further having a threaded spindle mounted on said threaded bolt outside component (A) for applying compression by turning said spindle.

* * * * *